US005169000A

United States Patent [19]

Kovács

[11] Patent Number: 5,169,000

[45] Date of Patent: Dec. 8, 1992

[54] CONTAINER BOX

[75] Inventor: György Kovács, Budapest, Hungary

[73] Assignee: Tungsram Részvénytársaság, Budapest, Hungary

[21] Appl. No.: 836,979

[22] Filed: Feb. 19, 1992

[30] Foreign Application Priority Data

Feb. 19, 1991 [HU] Hungary ..... 538/91

[51] Int. Cl.[5] ..... B65D 85/42

[52] U.S. Cl. ..... 206/422

[58] Field of Search ..... 206/422, 419

[56] References Cited

U.S. PATENT DOCUMENTS

| | | | |
|---|---|---|---|
| 2,593,689 | 4/1952 | Mitchell | 206/422 |
| 2,654,472 | 10/1953 | White | 206/422 |
| 4,441,650 | 4/1984 | Caldwell et al. | 206/422 |
| 4,903,892 | 2/1990 | McNair et al. | 206/422 |

FOREIGN PATENT DOCUMENTS

| | | | |
|---|---|---|---|
| 0133242 | 10/1989 | European Pat. Off. | 206/422 |
| 951777 | 3/1964 | United Kingdom | 206/422 |
| 1545465 | 5/1979 | United Kingdom | 206/422 |

*Primary Examiner*—William I. Price

*Attorney, Agent, or Firm*—Spencer, Frank & Schneider

[57] ABSTRACT

A container box for packaging at least two side-by-side situated items such as light bulbs, includes a plurality of serially interconnected side sheets defining an inner box space having opposite ends defining an inserting direction in which the items are introduced into the inner box space; closing tabs attached to the side sheets for closing the box ends; and a support tab partially cut out from one of the side sheets. The support tab includes a bridging band having one end attached to the side sheet and a width of at least 3 mm; a folding line extending across the bridging band parallel to the band width and the inserting direction; and a partition attached to another end of the bridging band and having a maximum width measured parallel to the width of the bridging band. The maximum width is at least 1.5 times the width of the bridging band. The bridging band is bent out of its side sheet towards the inner box space, whereby the partition is situated in the inner box space for separating the two items from one another.

9 Claims, 3 Drawing Sheets

CONTAINER BOX

BACKGROUND OF THE INVENTION

The present invention relates to a container box for packaging at least two electric light sources, particularly incandescent lamps, composed of side sheets forming the continuation of each other and closing tabs connected with the side sheets to form the enveloping surface of a prism wherein at least one of the said side sheets is provided with a support tab partly cut out from the material of the side sheet still being connected with the side sheet along a folding line, the support tab being bent around the folding line into the inner space of the container box, and a space division insert is placed in a given case in the inner space of the container box.

Various products are protected from being damaged in shipment and storage by making use of packaging materials.

These products include the electric light sources of fragile nature that are shipped and stored in means, usually in boxes protecting them from mechanical impacts. Now, container boxes being able to accept more than one electric light source are gaining ground.

In the U.S. Pat. No. 4,441,650 a container made from paper and being able to accept two incandescent lamps is described. In this container, each of the incandescent lamps placed to face one another is supported by a tab member having an arc-shaped edge and placed on the open side sheet. The first tab member is pressed against the incandescent lamp and the second, against the base part for connection to a lamp holder.

This solution has the advantage of enabling two incandescent lamps to be placed in one single container, but it also suffers from the disadvantage that the portions of the incandescent lamps facing the inner space of the container are in contact with each other. The lamp portions being pressed against each other may result in cracking or breakage of the incandescent lamps.

Another disadvantage of the above container is that the sides facing the tab members are actually open with the consequence that the incandescent lamps are exposed to an increased hazard of breakage on these sides. This is because if an impact occurs here, it may directly hit the bulbs.

In the European Patent 133 242 packaging means for two electric lamps is disclosed in which a tab member formed from the material of the box protrudes between the two lamps facing each other.

The folding line of the tab member makes an angle of 40°–45° with the direction along which the lamps are placed into the box.

The solution has the advantage that the tab member protruding into the inner space of the box and placed between the two electric lamps can be used to serve its purpose when electric lamps of definite size and shape are safely separated from each other.

SUMMARY OF THE INVENTION

Object of the present invention is to provide a container box that keeps the advantageous features of the known containers and ensures a satisfactory separation between the electric light sources packaged side by side, even in the case when light sources with different bulb shapes are placed in the container box.

Another object of the invention is to enable simple production of the container box as well as easy and rapid placing of the electric light sources into the container box and moreover, the use of the container box for packaging performed on automated packaging equipments.

The invention is based on the recognition that the container box can be made suitable for packaging a broad range of electric light sources if the support tab protruding into the inner space of the box has a unique shape geometry differing from those known so far and if the folding line of the support tab is parallel to the direction along which the electric light sources are placed into the container box.

Accordingly, the container box according to the invention for packaging at least two electric light sources, particularly incandescent lamps which container box is composed of side sheets forming the continuation of each other and closing tabs connected with the side sheets to form the enveloping surface of a prism wherein at least one of said side sheets is provided with a support tab partly cut out from the material of the side sheet still being connected with the side sheet along a folding line, the support tab being bent around the folding line into the inner space of the container box and a space division insert is placed in a given case in the inner space of the container box, and is shaped in the way that the support tab is provided with cuts starting from the folding line of the side sheet and directed towards the edge of the support tab opposite to the folding line and the cuts define a neck-shaped bridging band with a minimum width of 3 mm, the bridging band enters a partition that forms a part of the support tab, the maximum width of the partition being at least 1.5 times that of the width of the bridging band and the direction of the folding line is parallel to the direction along which the light sources are placed into the container box.

The container box according to the invention may have a further ; feature that the partition of the support tab contains arc-shaped diverging cuts forming prolongations of the cuts.

In a preferred embodiment in which the distance between the base points of the support tab cutout line placed at the folding line exceeds the width of the bridging band.

In a possible embodiment, those portions of the partition of the support tab that are adjacent to the folding line, are cut out.

In a still further embodiment, the space division insert is placed between the, side sheet containing the support tab and the side sheet opposite to it.

In another preferred embodiment the inner space of the container box is divided into two portions by the space division insert. The smaller portion accepts one light source and a larger portion accepts two light sources, and the support tab is bent into the larger portion.

According to a further feature of the container box according to the invention the inner space of the container box is, by the space division insert, divided into two portions each accepting two light sources and one support tab is bent into each portion.

The invention has several advantages. This is explained by the fact that the partition protruding through a narrow bridging band into the inner space of the container box along the direction of placing the electric light sources into the container box, can turn away (twist) to an extent that corresponds to the shape of the bulb which also enables to separate or "isolate" light sources of any shape from each other.

It is a further advantage that the torsion energy accumulated in the bridging band caused by its torsion ensures a stretching force satisfactory for keeping the electric light sources at a certain distance from each other. Therefore, the two electric light sources are protected from the effect of mechanical impacts not only by the partition between them, but also the energy accumulated in the bridging band exerts a favourable effect to attenuate the forces from collisions.

It should also be considered an advantage that the shaping of the support tab ensures a simple producibility as well as easy and rapid packaging, whether the packaging is performed manually or automatically.

DESCRIPTION OF THE PREFERRED EMBODIMENTS

Figure 1:
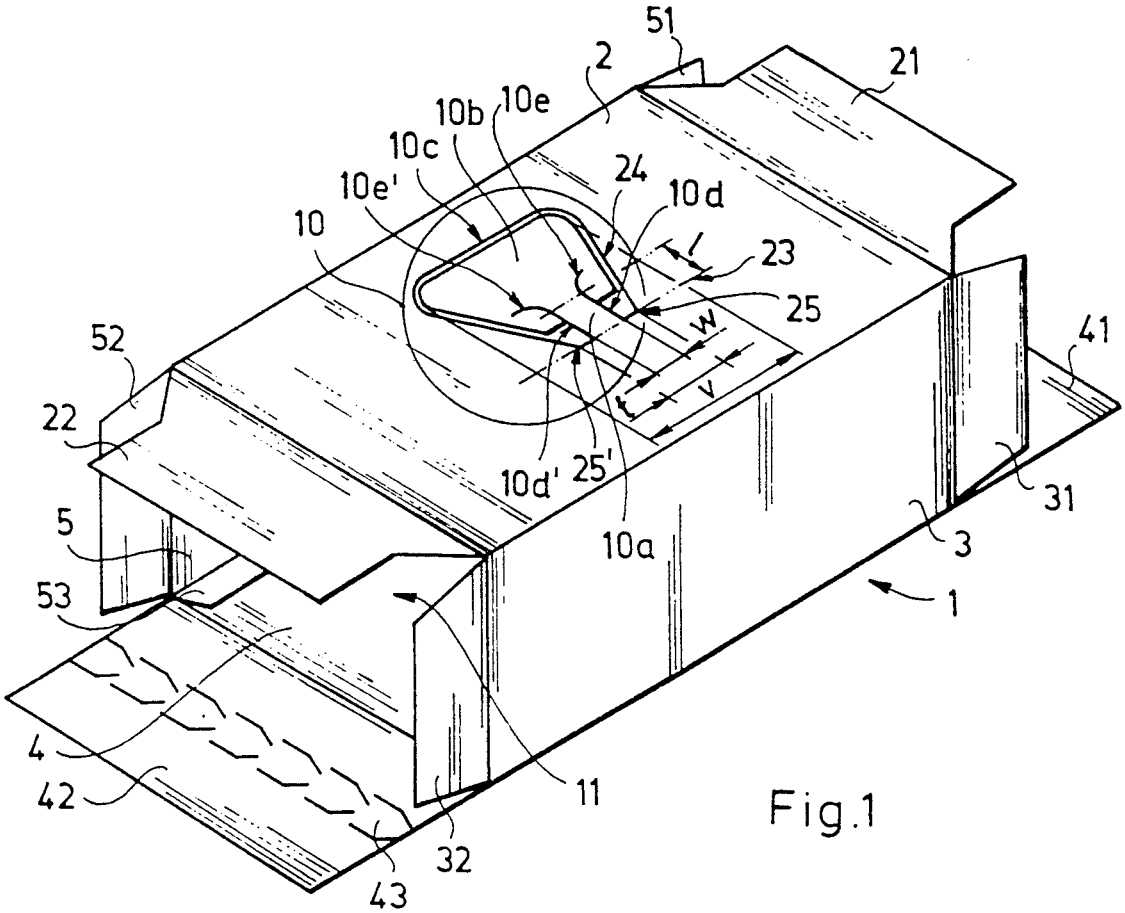
FIG. 1 is a perspective view of the container box according to the invention.

FIG. 1 illustrates the container box according to the invention. The material of the container box 1 is paper, e.g. a 350 g/mm$^2$ bleached sulphate-cellulose-base paper sheet, the outer surface of which can be provided with designations (text or figures) using the printing technology.

The material of the container box 1 can also be—depending on the size and mass of light sources 7, 8 and 8' (not shown in the Figures) another paper type commonly used in the packaging technology.

It is seen that side sheets 2, 3, 4 and 5 form the enveloping surface of a parallelepipedon. Closing tabs 21 and 22 are connected with the two opposite edges of the side sheet 2 and closing tabs 31 and 32, with the side sheet 3 and closing tab 41 as well as extractable tab 42, with the side 4 and extractable tabs 51 and 52, with the side sheet 5. It is practical to make the parts of the container box 1 from one single paper sheet so that the parts form a continuous unit when spread out. Finally, the container box 1 is—as seen in FIG. 1—assembled to form a parallelepipedon by gluing a connecting flange 53 belonging to the side sheet 5 to the side sheet 4.

In order to ensure that the container box 1 can be easily opened, the extractable tab 42 is provided with a perforated portion 43 that can be torn to bend out the closing tabs 22, 32 and 52 and in this way the inner space 11 of the container box 1 will be accessible.

The support tab 10 consisting of a bridging band 10*a* and a partition 10*b* is found on the side sheet 2. The bridging band 10*a* is a narrow, actually neck-shaped portion confined by cuts 10*d* and 10*d'* starting from a folding line 23 and directed towards the bordering edge 10*c* of the support tab 10 which bordering edge 10*c* is placed opposite to the folding line 23. The width w of the bridging band 10*a* is at least 3 mm, but it can also be wider depending on the type and thickness of the material of the container box 1 and the length l of the bridging band 10*a*. It should also be noted that it is not practical to choose a value for the length l of the bridging band 10*a* smaller than half the width w since in this case it may cause difficulties to bend the support tab 10 into the inner space 11 of the container box 1 and it can also happen that the bridging band 10*a* will be partly torn at the folding line 23 when the partition 10*b* twists. In this embodiment, arc-shaped cuts 10*e* and 10*e'* forming the continuation of the cuts 10*d* and 10*d'* are found in the partition 10*b* of the support tab 10. These may have the shape of a quarter circle deflecting towards the cutting line 24 and have the role of eliminating the hazard of breakage or tear occurring at the juncture of the bridging band 10*a* and the partition 10*b*.

It is also seen in FIG. 1 that the distance t between the base points 25 and 25' of the cutout line 24 defined by the juncture of this line and the folding line 23 exceeds the width w of the bridging band 10*a*. This is required by the packaging operation performed on a packaging machine as this enables the bender head of the machine to bend the bridging band 10*a* inwards very safely without causing damage to the side sheet 2 of the container box 1, adjacent to the support tab 10. The distance t is determined with the knowledge of the bender head dimensions.

It is noted here that the container box illustrated in FIG. 1 is designated for automated packaging. In the case of manual packaging, it is practical to use shapes of closing tabs 21, 22, 31, 32, 41, 42, 51 and 52 differing from that shown and being customary with conventional container boxes. The shaping of the support tab 10 of the container box 1 shown in FIG. 1 is different from that of the support tab 10 according to FIG. 2.

Figure 2:
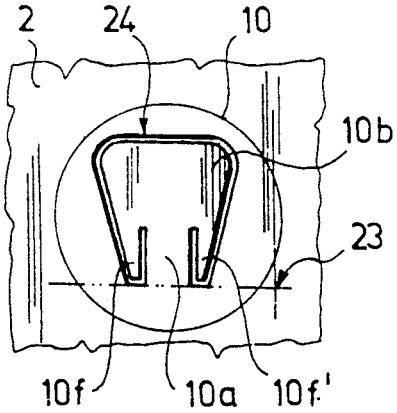
FIG. 2 shows an embodiment of the support tab in top view.

In FIG. 2, portions 10*f* and 10*f'* of the partition 10*b* of the support tab 10 surround the bridging band 10*a* and reach down to the folding line 23. In this way, the support tab 10 practically fills up the area bordered by the cutout line 24. In FIG. 1, the portions of the partition 10*b*, corresponding to portions 10*f* and 10*f'* of FIG. 2 are cut out adjacent to the folding line 23.

Figure 3:
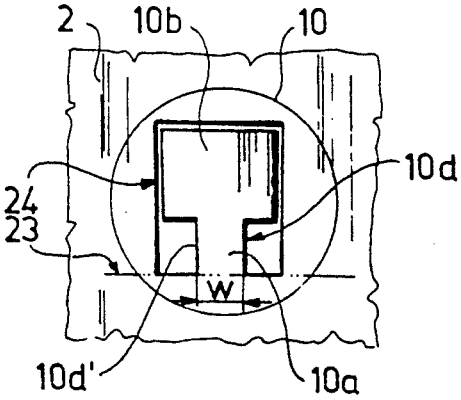
FIG. 3 shows another embodiment of the support tab in top view.

The support tab 10 seen in FIG. 3 has still another shape, and of the support tabs 10 shown so far, it has the simplest shape.

It is a requirement for all three embodiments and for any other container box 1 differing from these, but falling within the scope of the invention that the maximum width v of the partition 10*b* is at least 1.5 times the width w of the bridging band 10*a*, because a narrower partition 10*b* is unable to "isolate" the light sources 7 and 8 safely from each other. In the package seen in FIG. 4 where a container box 1 containing 3 incandescent lamps of 100 watts is shown, the width w of the bridging band 10*a* is 8 mm and the maximum width v of the partition 10*b* is 50 mm. When light sources 7, 8 and 8' with smaller bulbs 71, 81 and 81' are involved, the size of the partition 10*b* may also be smaller.

Figure 4:
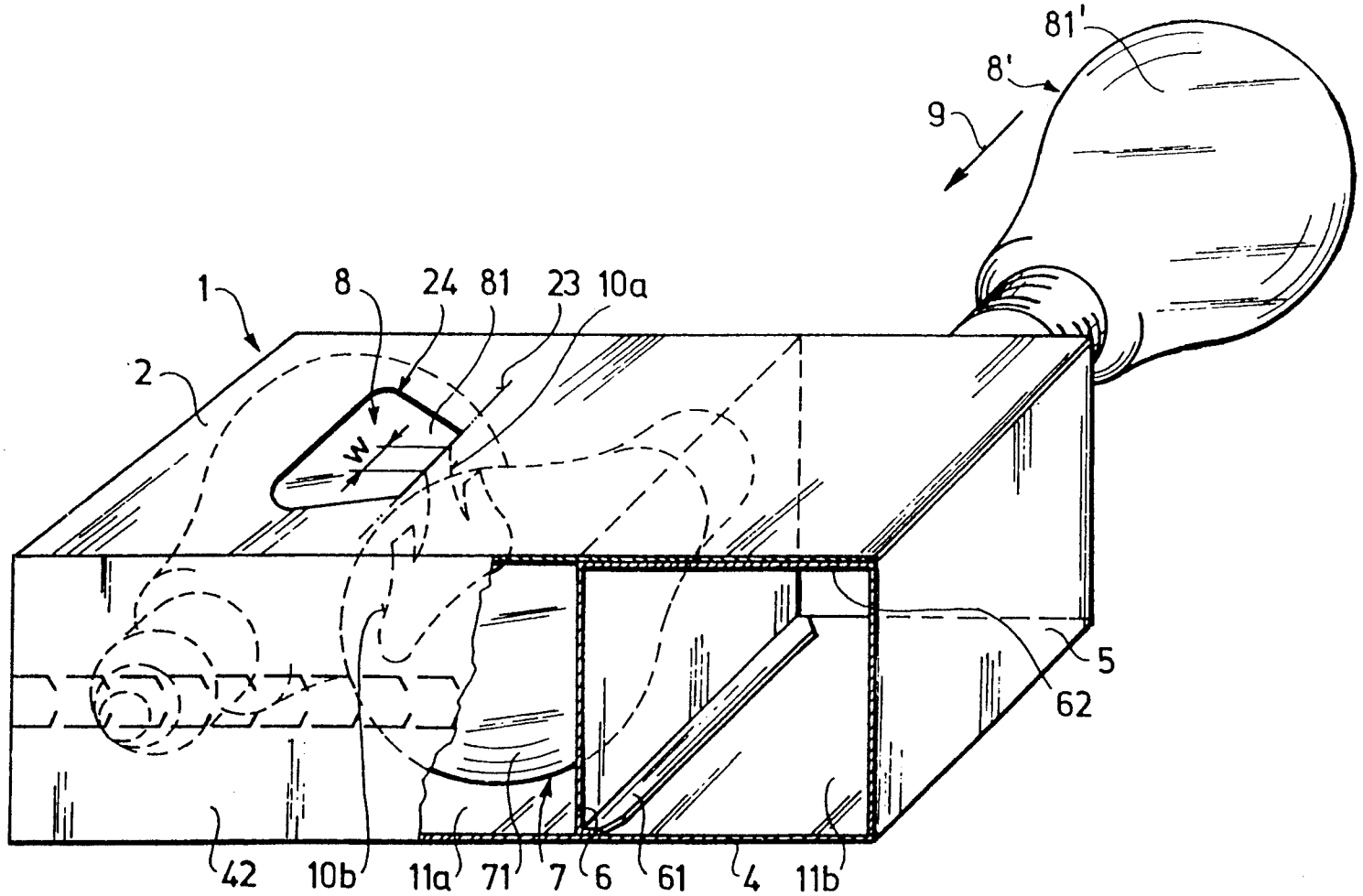
FIG. 4 is a perspective view of another embodiment of the container box, partly in section

The container box shown in FIG. 4 is also provided with a space division insert 6 that serves to divide the inner space 11 into a larger space portion 11*a* and a smaller space portion 11*b*.

The space division insert 6 is connected partly with the folded-up member 62 forming the continuation of the side sheet 5 and partly with the bridging tab 61. The folded-up member 62 is glued from inside to the surface of the side sheet 2 facing the inner space 11 and the bridging tab 61 is glued to the side sheet 4 being opposite to the side sheet 2 that carries the support tab 10. It is not necessary to fix the space division insert 6 to both side sheets 2 and 4 of the container box 1, but the embodiment shown in this Figure has the advantage of keeping the strength of the container box 1 in spite of the fact that this container box is larger than that shown in FIG. 1 which includes the increased surface of the side sheets 2 and 4.

The container box 1 has been drawn by removing a part of the extractable tab 42 and also those portions that fall into this area so that the position and fixing of the space division insert 6 can be clearly seen.

FIG. 4 shows that the direction of the folding line 23 on the side sheet 2 is identical with the direction 9 along which the light source 8' is placed into the box. The support tab 10 protrudes between the bulbs 71 and 81 of the light sources 7 and 8 placed in the larger space portion 11*a*. In this way the portion of the side sheet 2 bordered by the cutout line 24 will become a free opening through which the bulbs 71 and 81 are partly seen.

In the packaging operation, the support tab 10 is bent into the larger space portion 11*a* of the inner space 11 of the container box 1 and the light sources 7 and 8 are pushed into container box 1. During this, the partition 10*b* will be deformed corresponding to the shape of the bulbs 71 and 81 to separate the two bulbs 71 and 81 from each other. Caused by the torsion of the partition 10*b*, the bridging band 10*a* will also turn away. The displacement causes the bridging band 10*a* to accumulate torsion energy that tends to restore the original position of the bridging band 10*a* and, through this, of the partition 10*b* also.

The mechanism described above tends in effect to increase the distance between the light sources 7 and 8. As a result of this, not only the partition 10*b* placed between the light sources 7 and 8 will contribute to the protection of the light sources 7 and 8 from mechanical impacts, but also the resilient stress acting through the partition 10*b*.

The next step of packaging is to slip the light source 8' into the container box 1 and finally to close the container box with closing tabs.

Figure 5:
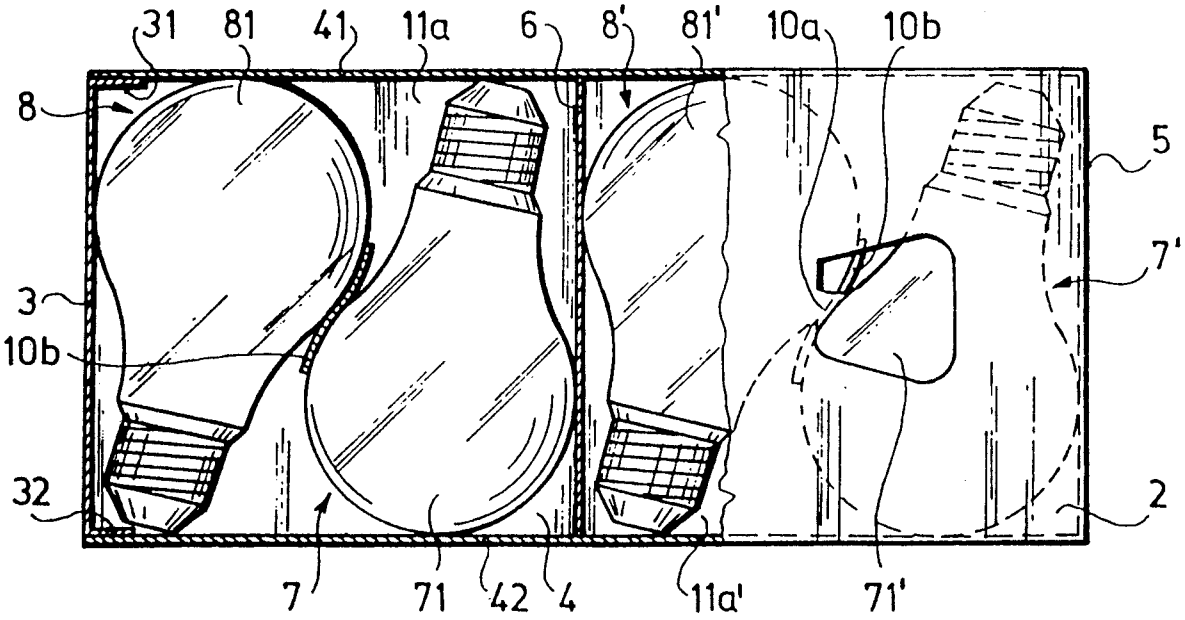
FIG. 5 is a side elevational view of a further embodiment of the container box, partly in section.

In FIG. 5, a four-lamp package is shown with a side elevational view of the container box 1, partly in section. The shape of the container box 1 differs from that described in connection with FIG. 4 exclusively in that the space division insert 6 divides the inner space 11 into two equal-sized space portions 11*a* and 11*a'*, each of which being able to accept two light sources 7 and 8 as well 7' and 8', respectively. In addition, the side sheet 2 is provided with two support tabs 10, each of which protrudes into one of the space portions 11*a*. These support tabs 10 are not shown here for the sake of clarity.

In FIG. 5 in the sectionally shown left-side portion of the container box 1, it is clearly seen how the partition 10*b* is deformed due to which this partition 10*b* "isolates" the bulbs 71 and 81 of the light sources 7 and 8 from each other.

This is similarly seen in the right-side portion of the FIG. with the difference that the twisted position of the bridging band 10*a* can also be viewed here.

The container box according to the invention can be well used for packages containing two or more light sources of various shapes.

I claim:

1. A container box for packaging at least two side-by-side situated items, comprising (a) a plurality of serially interconnected side sheets defining an inner box space having opposite ends; said ends defining an inserting direction in which the items are introduced into the inner box space;

(b) closing tabs attached to said side sheets at said ends for closing said ends; and (c) a support tab partially cut out from one of said side sheets; said support tab including (1) a bridging band having opposite first and second ends, a length and a width; said width being at least 3 mm; said bridging band being attached to said one sheet at said first end;

(2) a folding line extending across said bridging band parallel to said width and said inserting direction;

(3) a partition attached to said second end of said bridging band and having a maximum width measured parallel to the width of said bridging band; said maximum width being at least 1.5 times the width of said bridging band; said bridging band being bent out of said one side sheet towards said inner box space and said partition being situated in said inner box space for separating the two items from one another.

2. A container box as defined in claim 1, wherein said bridging band has opposite edges extending along said length; said edges extending arcuately and mutually divergently into an area of said partition.

3. A container box as defined in claim 1, wherein said one side sheet has a cutout edge along which the support tab has been partially cut out from said one side sheet; said cutout edge having two base points lying on either side of said bridging band on an imaginary line coinciding with said folding line; the distance between said two base points being greater than the width of said bridging band.

4. A container box as defined in claim 1, wherein said second end of said bridging band is situated inside an area of said partition and further wherein said partition has edge portions at either side of said bridging band, in the immediate vicinity of said folding line.

5. A container box as defined in claim 1, wherein said partition has edge portions situated closest to said folding line and being spaced therefrom by an air gap extending along a length portion of said bridging band.

6. A container box as defined in claim 5, wherein said second end of said bridging band is situated immediately adjacent said edge portions.

7. A container box as defined in claim 7, further comprising a division insert situated in said inner box space between said one side sheet and a side sheet extending opposite said one side sheet.

8. A container box as defined in claim 7, wherein said division insert divides said inner box space into two unequal volumes bounded by said one side sheet; said partition being situated in the larger of said unequal volumes for separating two items accommodated therein; the smaller of said unequal volumes being sized to receive a single item.

9. A container box as defined in claim 7, wherein said division insert divides said inner box space into first and second volumes each sized to accommodate two items; further wherein said support tab is a first support tab; further comprising a second support tab carried by one of said side sheet; said second support tab being structured identically to said first support tab; said first support tab extending into said first volume and said second support tab extending into said second volume.

* * * * *